US008240465B2

(12) United States Patent
Bennett

(10) Patent No.: US 8,240,465 B2
(45) Date of Patent: Aug. 14, 2012

(54) PROTECTIVE COVER FOR NATURAL FIBER APPAREL

(76) Inventor: Cynthia Bennett, San Diego, CA (US)

( * ) Notice: Subject to any disclaimer, the term of this patent is extended or adjusted under 35 U.S.C. 154(b) by 0 days.

(21) Appl. No.: 12/843,336

(22) Filed: Jul. 26, 2010

(65) Prior Publication Data

US 2012/0018320 A1 Jan. 26, 2012

(51) Int. Cl.
*B65D 85/18* (2006.01)
*A45C 3/00* (2006.01)

(52) U.S. Cl. ..... 206/287; 206/279; 206/289; 190/903; 383/23; 383/97

(58) Field of Classification Search ..... 206/213, 206/278, 279, 282, 284, 286–287.1, 289, 206/300; 190/903; 223/84.89; 383/23, 97
See application file for complete search history.

(56) References Cited

U.S. PATENT DOCUMENTS

| | | | | | |
|---|---|---|---|---|---|
| 1,652,269 | A | | 12/1927 | Bremner | |
| 1,706,041 | A | * | 3/1929 | Potdevin | 206/280 |
| 2,238,217 | A | * | 4/1941 | Enrich | 206/213 |
| 2,619,225 | A | * | 11/1952 | Mintz | 206/213 |
| 3,043,423 | A | | 7/1962 | Shenker | |
| 3,469,679 | A | | 9/1969 | Kamins et al. | |
| 3,737,013 | A | * | 6/1973 | Powell | 206/287.1 |
| 3,776,372 | A | | 12/1973 | Lemelson | |
| 3,831,740 | A | | 8/1974 | Pendergast et al. | |
| 3,929,224 | A | * | 12/1975 | Smith, Jr. | 206/287 |
| 4,282,911 | A | | 8/1981 | Sumitomo | |
| 5,050,256 | A | * | 9/1991 | Woodcock | 5/699 |
| 5,593,038 | A | * | 1/1997 | Lyon | 206/527 |
| 5,746,360 | A | | 5/1998 | Chen | |
| 6,840,068 | B2 | | 1/2005 | Pasin et al. | |
| 6,988,286 | B2 | * | 1/2006 | Schecter et al. | 5/645 |
| 7,124,884 | B2 | * | 10/2006 | Felsenthal | 206/278 |
| 2007/0151877 | A1 | | 7/2007 | Newman | |
| 2007/0179864 | A1 | * | 8/2007 | Leeds | 705/26 |
| 2010/0006459 | A1 | | 1/2010 | Foley | |
| 2010/0224515 | A1 | * | 9/2010 | Siegel et al. | 206/279 |

FOREIGN PATENT DOCUMENTS

| | | |
|---|---|---|
| FR | 2799744 | 10/2000 |
| JP | 2001171696 | 6/2001 |

* cited by examiner

*Primary Examiner* — Sue Weaver
(74) *Attorney, Agent, or Firm* — Eric A. Hanscom; Todd J. Langford

(57) ABSTRACT

A protective cover for natural fiber apparel to protect the apparel from moths, moth larvae, and other pests is disclosed. The protective cover encloses not only natural fiber apparel, but also a hanger from which the apparel is hung. A substantial portion of the protective cover is made from a fabric that prevents moths and other insects from penetrating the protective cover and depositing eggs or consuming the apparel therein. At the same time, this fabric allows air to travel therethrough. A window is incorporated into the body of the protective cover to allow users to view the one or more apparel items protected by the protective cover. The protective cover also includes a zipper along its outer edge to allow access to the apparel contained within.

16 Claims, 2 Drawing Sheets

PROTECTIVE COVER FOR NATURAL FIBER APPAREL

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of apparel, and more specifically toward a protective cover for natural fiber apparel. The protective cover encloses not only natural fiber apparel, but also a hanger from which the apparel is hung. A substantial portion of the protective cover is made from a fabric that prevents moths and other insects from penetrating the protective cover and depositing eggs or consuming the apparel therein. At the same time, this fabric allows air to travel therethrough. A window is incorporated into the body of the protective cover to allow users to view the one or more apparel items protected by the protective cover. The protective cover also includes a zipper along its outer edge to allow access to the apparel contained within.

Many moths are considered pests because their larvae consume natural proteinaceous fibers, such as wool, fur, and silk. An adult moth will lay eggs, which are generally 1 mm or less, in carefully chosen locations that provide easy access to food. Eggs are attached with a glue-like substance that make the eggs difficult to remove. Once the eggs hatch, the larvae promptly begin looking for food. In the case of unlucky owners of natural fiber apparel, the larvae consume the natural fibers to turn keratin into food. This process permanently damages the apparel by creating unsightly holes. In fact, it has been suggested that clothes moths cause upwards of one billion dollars of damage each year in the United States alone. Thus, there is a significant need to prevent the larvae of moths from coming in contact with and consuming apparel made of natural fibers.

Many attempts have been made to protect clothing from moths. Cryofumigation, or fumigating an object using dry ice, suffocates all stages of clothing moths. While this is an effective treatment for killing infested apparel, it does not prevent moths from laying eggs on the clothing and the larvae from eating the apparel. Further, it requires enclosing the apparel within an airtight bag with dry ice for three to five days. Not only is this an expensive and time-consuming process, it does not prevent future infestation of the apparel by moths.

Extreme temperatures can also be used to kill moths and deter them from laying eggs on clothing. By keeping the apparel frozen (at temperatures below 32° F.) for several days, or by heating the apparel to a temperature of greater than 120° F. for a period of 30 minutes or more, the larvae and/or moths present on or around the apparel will be exterminated and new eggs will not be deposited on the clothing while at these extreme temperatures. While this can be an effective form of disinfecting and storage, it is often not practical as maintaining these extreme temperatures can consume relatively large amounts of energy.

Different forms of insecticide can be used to kill moths and larvae, prevent pupation larvae, and deter deposition of eggs by moths on apparel. Mothballs have historically been a common form of treating for and preventing apparel consuming moth larvae. Older mothballs typically contained naphthalene. Naphthalene is not only somewhat toxic and carcinogenic, it is also highly flammable. Newer mothballs use paradichlorobenzene; while not flammable, paradichlorobenzene is somewhat toxic and carcinogenic. Because of the toxicity of mothballs, they are not child or pet safe. Other insecticides used to combat apparel-consuming moths are permethrin, pyrethroids, and pyriproxyfen.

Biological measures, while more environmentally friendly, have limited effectiveness and often unwanted side-effects. Ceder wood, specifically eastern red ceder, has been known to be somewhat effective in deterring moths, but loses its effectiveness within a few years. Common lavender has also been used with some success, but has a very distinct odor that is infused into the clothing. Various species of wasps have been used with limited success, whereby the wasp deposits eggs on or near the eggs of the moth. When the wasp eggs hatch, the wasp larvae seek out and consume the moth eggs and/or larvae.

Various means of covering apparel are disclosed in the prior art. French Patent Application No. 2 799 744 to Ventura discloses a clothes hanger with integral bag for displaying apparel comprising a transparent plastic bag with a hook at the top. The hook at the top of the bag is completely enclosed by the material of the bag.

Japanese Patent Application No. 2001171696 to Mori et al. teaches an apparel storage bag with a main body that is made of a plastic film having a gas barrier property. It includes a section with which a hanger hook can be freely engaged on its upper side and which allows for a completely sealed apparel storage bag that includes the hanger.

U.S. Pat. No. 6,840,069 to Pasin et al. discloses an appliance for refreshing/cleaning cloth items with a container in the general configuration of a garment bag. The flexible portions of the container have a vapor permeability of 3,000 grams of water/$m^2$/day or less to allow for limited permeability so the container of the appliance can breathe. The container also includes a transparent window for viewing the contents located therein.

U.S. Patent Application No. 2010/0006459 to Foley teaches a reusable dry cleaning bag that can act has a hanging garment cover and a tote bag. The dry cleaning bag is made from nylon, polyester, cotton/canvas, rayon, and/or other breathable materials. A window is included in the dry cleaning bag to allow users to identify the apparel hanging inside of the dry cleaning bag.

Thus there has existed a long-felt need for a protective cover for natural fiber apparel that allows users to easily and effectively protect their apparel from moths and other harmful insects while allowing air to circulate therethrough. Such a protective cover should accommodate apparel on a hanger and allow for easy access to cover and uncover the apparel and hanger. The need continues for such a protective cover that shows the contents located therein.

SUMMARY OF THE INVENTION

The current invention provides just such a solution by having a protective cover for natural fiber apparel. The protective cover encloses not only a natural fiber apparel, but also a hanger from which the apparel is hung. A substantial portion of the protective cover is made from a fabric that prevents moths and other insects from penetrating the protective cover and depositing eggs or consuming the apparel therein. At the same time, this fabric allows air to travel therethrough. A window is incorporated into the body of the protective cover to allow users to view the one or more apparel items protected by the protective cover. The protective cover also includes a zipper along its outer edge to allow access to the apparel contained within.

The material used for the protective cover must prevent the larvae of moths to penetrate the material and consume the apparel located within. While prior art solutions use air impermeable materials, the current invention uses material with small sized pores to prevent eggs from being deposited through the pores or larvae travelling through the pores while at the same time allowing air and/or moisture to travel therethrough. To this end, the current invention preferably uses a material that has an average pore size of 5.15 microns.

It is a principal object of the invention to provide a protective cover for natural fiber apparel that protects apparel from the larvae of moths.

It is another object of the invention to provide a protective cover for natural fiber apparel that prevents eggs of moths from being deposited therethrough.

It is a further object of the invention to provide a protective cover for natural fiber apparel with a means of seeing the apparel located within the protective cover.

It is an additional object of the invention to provide a protective cover for natural fiber apparel that encloses not only the natural fiber apparel, but also the hanger on which the apparel is hanging.

It is a final object of this invention to provide a protective cover for natural fiber apparel that allows air to pass through the protective cover.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 1:
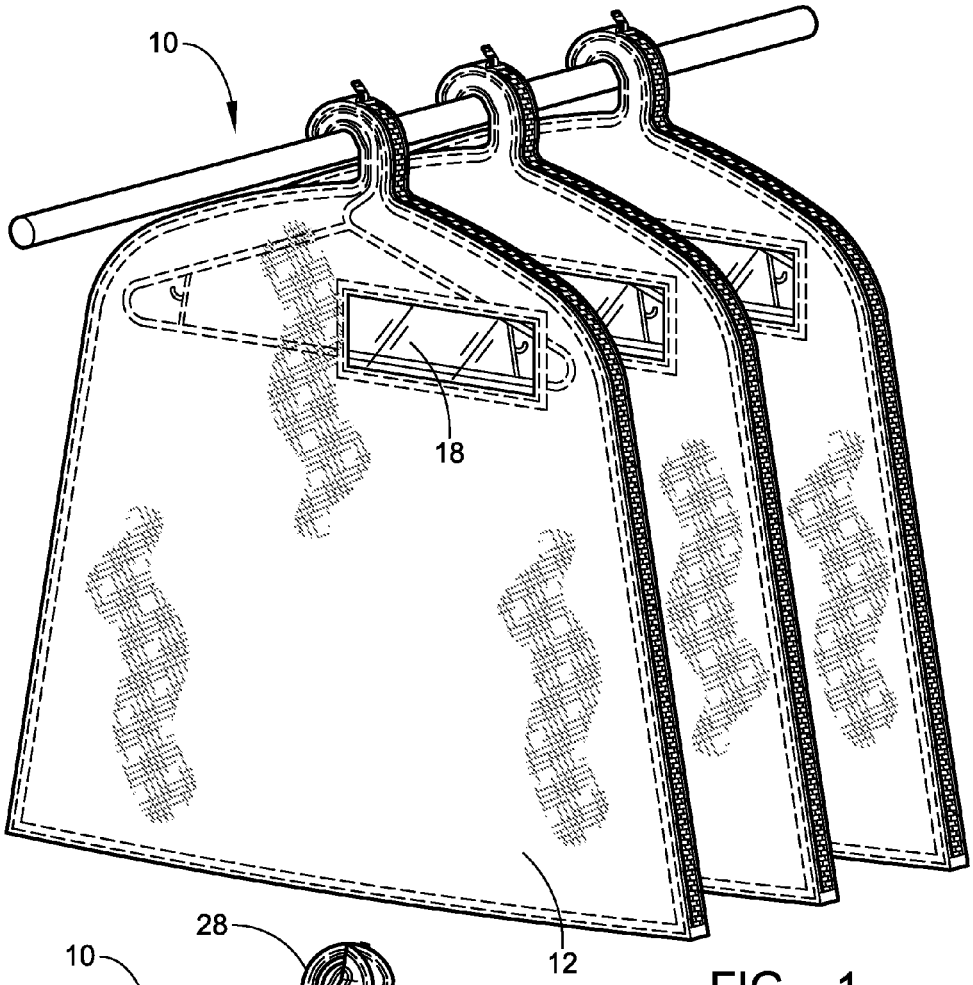
FIG. 1 is a perspective view of three protective covers, according to an embodiment of the current invention, hanging on a clothes rod.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

FIG. 1 is a perspective view of three protective covers, according to an embodiment the current invention, hanging on a clothes rod. Each protective cover 10 includes a window 18 that allows individuals to see what apparel is contained within the main body 12 of the protective cover 10.

Figure 2:
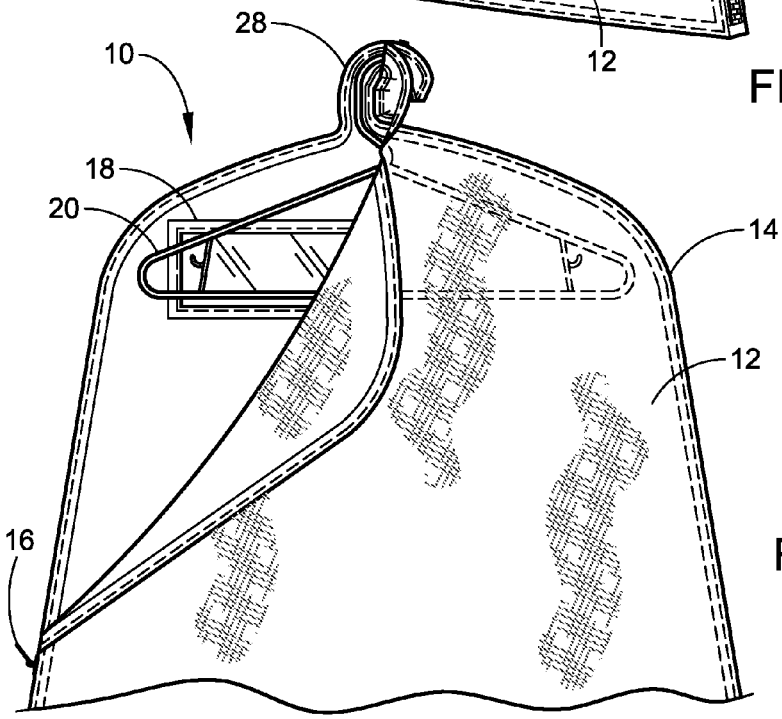
FIG. 2 is a partial back view of the protective cover in a partially opened position.

FIG. 2 is a partial back view of the protective cover in a partially opened position. A zipper 16 is used to access the main body 12 of the protective cover 10. A hook portion 28, which is a part of the main body, covers the hook of a hanger 20 such that the apparel and hanger are completely enclosed within the protective cover 10. The zipper 16 extends from the top of the hook portion 28 down to the bottom of the main body 12. Thus, the zipper is located on one side of the protective cover 10 leaving the other side as the non-opening side 14. The window 18 in the body allows individuals to see what apparel is contained within the main body 12 of the protective cover 10. The main body 12 and window 18 form a compartment, which is accessed by means of a zipper. In other words, users open and close the compartment formed by the main body and window by unzipping and zipping the zipper.

Figure 3:
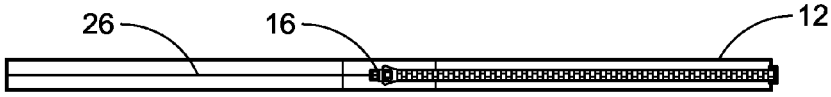
FIG. 3 is a top view of the protective cover.

FIG. 3 is a top view of the protective cover. The zipper 16 extends down the side of the main body 12. The top portion 26 of the opposite side does not open. The zipper itself should be of a size to prevent moths and/or larvae from travelling therethrough.

Figure 4:
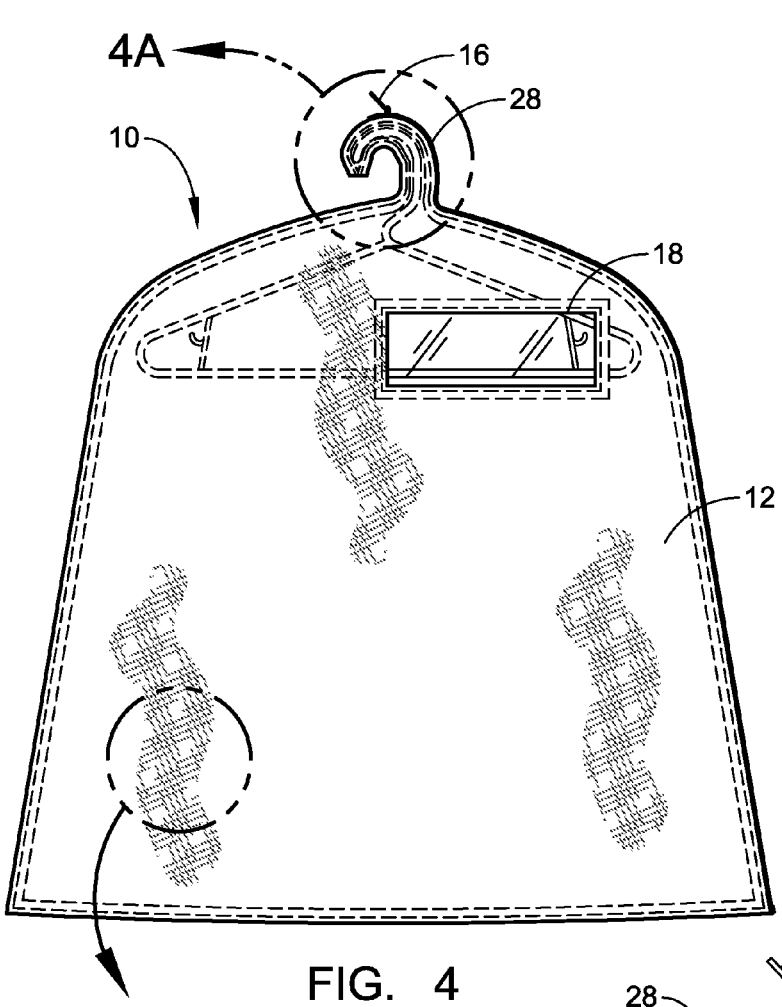
FIG. 4 is a front view of the protective cover.

FIG. 4 is a front view of the protective cover. The main body 12 is made from a fabric, more clearly shown in FIG. 4B, that excludes moths, moth larvae, or moth eggs while still allowing air to pass therethrough. The zipper 16 extends from the top of the hook portion 28 to the bottom of one side of the main body 12. The window 18 in the body allows individuals to see what apparel is contained within the main body 12 of the protective cover 10. The window is a clear portion built into the main body preferably made from a clear plastic material, where the clear plastic material is transparent or translucent. As an alternative to plastic, the window is made from a sheer fabric that provides some measure of translucency. For example, an organza (made of nylon, polyester, or rayon) or microfiber (made of acrylic, nylon, polyester, or rayon) fabric with a pore size less than or equal to that of the rest of the main body is sufficient for use as the window.

Figure 4B:
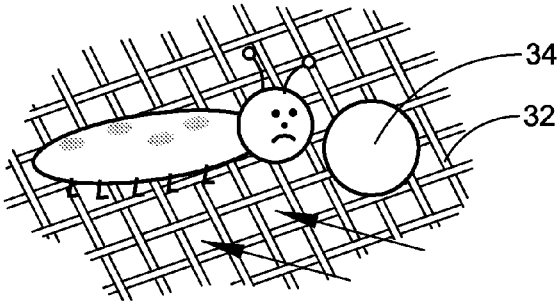
FIG. 4B is a close-up view of the material used in FIG. 4.
Figure 4A:
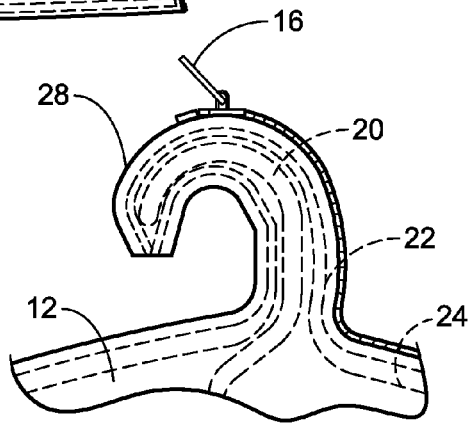
FIG. 4A is a close up view of the top portion of the protective cover in FIG. 4.

FIG. 4A is a close up view of the top portion of the protective cover in FIG. 4. The hook portion 28 is a part of the main body and thus is made from the same material. However, it may be preferable to provide a thicker fabric for the hook portion to provide additional support and resistance against wear and tear. In a preferred embodiment, the thicker fabric is created by using two layers of material. Since the top portion is flexible, the hook of a hanger 20 can slide into the hook portion 28. Further, the zipper 16 extends up to the top of the hook portion 28, thus giving easier access to place the hook of a hanger 20 into the hook portion 28. Dashed lines 22 and 24 represent stitching that is used to secure the different parts of the main body 12 together. It is important to note that the holes created by the stitching and the stitching itself should not create an opening greater than the pore size of the material used in the main body.

FIG. 4B is a close-up view of the material used in FIG. 4. In this figure, a moth larvae and a moth egg 34 are shown next to the fabric 32 of the main body 12. The arrows show air that can travel through the fabric 32, while the moth larvae and moth egg 34 cannot. The type of fabric used in the protective cover is an integral part of the current invention. In one embodiment, fabric with a thread count of between 200 and 300, and more preferably 285, is employed. Thread count, or threads per inch, is the measurement of the number of threads in a square inch, and includes both the vertical and horizontal threads. In another embodiment, the fabric has a pore size of between 3 microns (micrometers) and 10 microns, and more preferably 4 microns and 6 microns. Even more preferably, the fabric has an average pore size of 5.15 microns. These specifications for the fabric are able to not only prevent moths from penetrating the protective cover to access natural fiber apparel contained therein, but also prevents moth larvae from accessing the natural fiber apparel or moths depositing eggs through the protective cover on the natural fiber apparel contained therein. At the same time, the porous nature of the fabric allows air to pass through, therefore providing fresh air to the apparel while it is being stored. The fabric itself is preferably made from non-natural fibers such that moth larvae will not consume the protective cover thus gaining access to the apparel located within. To this end, the fabric is preferably a synthetic fabric such as acrylic, acetate, nylon, latex, polyester, rayon, and spandex. Alternatively, plant fibers, such as cotton and linen, may be used as the fabric of the main body. However, it is important to note that natural plant fibers should be kept clean, as clothes moths have been known to consume natural plant fibers soiled with food stains and body oils.

Figure 5:
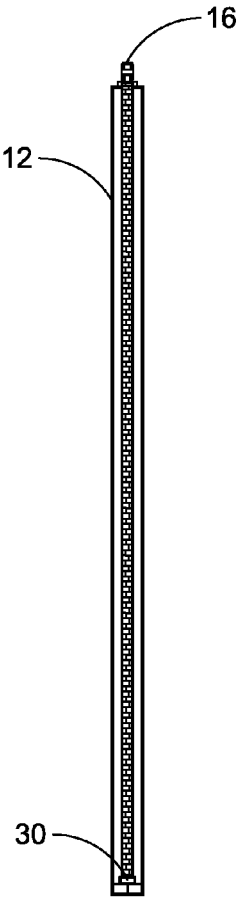
FIG. 5 is a side view of the protective cover.

FIG. 5 is a side view of the protective cover. As clearly shown in this figure, the zipper 16 extends from the top of the main body 12 down to the bottom, where the zipper end 30 is located at the bottom corner of the main body 12.

Natural fiber apparel, as used herein, is made from wool, furs, silk, and other materials often consumed by moths. The hangers discussed herein can be made from a variety of materials in various shapes and sizes. While one hanger is shown in each protective cover, it is nonetheless possible to place a plurality of hangers and natural fiber fabrics within a single protective cover. Pore size, as used herein, refers to the maximum distance between threads of a fabric.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A protective cover for natural fiber apparel comprising a main body, where the main body comprises a zipper and a hook portion, where the main body further comprises a fabric, where the fabric has a pore size of between 3 microns and 10 microns, where the hook portion is in the shape of a hook and is able to accept the hook of a hanger within, wherein the hook portion is able to hang from a clothes rod, where the zipper extends from the top of the hook portion to a side of the main body.

2. The protective cover of claim 1, wherein the main body further comprises a window, where the window consists of a clear plastic material.

3. The protective cover of claim 1, wherein the fabric consists of a material selected from the group consisting of synthetic fabrics, cotton, and linen.

4. The protective cover of claim 1, wherein the pore size of the fabric is between 4 microns and 6 microns.

5. The protective cover of claim 1, wherein the fabric has an average pore size of 5.15 microns.

6. The protective cover of claim 1, wherein the zipper extends to a bottom corner of the main body.

7. The protective cover of claim 1, wherein the fabric has a thread count of between 200 and 300.

8. The protective cover of claim 1, wherein the fabric has a thread count of 285.

9. The protective cover of claim 1, wherein the hook portion comprises a second fabric, where the second fabric forms a second layer of material.

10. A protective cover for natural fiber apparel consisting of a synthetic fabric, a clear material, and a zipper, where the synthetic fabric and the clear material form a compartment, where the compartment is accessed by the zipper, where the top of the compartment is in the shape of a hook and is able to accept the hook of a hanger within,wherein the top of the compartment is able to hang from a clothes rod where the zipper extends to the top of the compartment that is shaped to accept the hook of a hanger within, where the synthetic fabric has a pore size of between 3 microns and 10 microns.

11. The protective cover of claim 10, wherein the pore size of the synthetic fabric is between 4 and 6 microns.

12. The protective cover of claim 10, wherein the synthetic fabric has an average pore size of 5.15 microns.

13. The protective cover of claim 10, wherein the synthetic fabric has a thread count of between 200 and 300.

14. The protective cover of claim 10, wherein the synthetic fabric has a thread count of 285.

15. The protective cover of claim 10, wherein the clear material is a clear plastic material.

16. The protective cover of claim 10, where the compartment has two sides and a bottom, where the zipper extends to the corner between the side and the bottom.

* * * * *